United States Patent [19]

Rotolico

[11] 4,384,677

[45] May 24, 1983

[54] NOZZLE CONSTRUCTION FOR A GAS TORCH

[75] Inventor: Anthony J. Rotolico, Hauppauge, N.Y.

[73] Assignee: Eutectic Corporation, Flushing, N.Y.

[21] Appl. No.: 219,226

[22] Filed: Dec. 23, 1980

[51] Int. Cl.[3] ..... B05B 7/06

[52] U.S. Cl. ..... 239/427.3

[58] Field of Search ..... 239/85, 80, 413, 419, 239/422, 424, 427, 427.3, 296

[56] References Cited

U.S. PATENT DOCUMENTS 3,455,510 7/1969 Rotolico ..... 239/85

3,986,668 10/1976 Huhne et al. ..... 239/85

*Primary Examiner*—John J. Love

*Assistant Examiner*—Gene A. Church

*Attorney, Agent, or Firm*—Hopgood, Calimafde, Kalil, Blaustein & Judlowe

[57] ABSTRACT

The invention contemplates improved nozzle structure removably securable to a gas-distributor body for delivering and discharging independent flows of combustible-gas mixture and of powder material to be flame-sprayed by a gas torch to which the nozzle is fitted. The combustible-gas mixture is successively accommodated in annular manifold regions of relatively large sectional area, respectively upstream and downstream from an intermediate annular manifold region of relatively restricted sectional area, for inhibiting flash-back to the gas distributor and for effectively limiting any flash-back effects to the manifold region downstream of the annular restriction.

6 Claims, 3 Drawing Figures

NOZZLE CONSTRUCTION FOR A GAS TORCH

BACKGROUND OF THE INVENTION

The invention relates to oxy-acetylene and the like gas torches, and in particular to those which have application to the sprayed deposition of metal or other powdered material to form a coating on a substrate. Such torches are exemplified by constructions disclosed in Huhne et al. U.S. Pat. No. 3,986,668.

A torch of the character indicated must be able to apply intense heat to the powder material to be sprayed, and the problem of high-heat delivery for a given size torch increases as higher-temperature materials become available or are specified for incorporation in the powder formulation. Higher heat delivery means greater flows of oxygen and of fuel gas, and thus larger gas-flow passages, with increasing susceptibility to "flash-back", involving shock-wave transmission through the mixed-gas distribution system; and shock-wave incidence at the mixing locale is sufficient to extinguish the torch, thus frustrating the otherwise uniform coating or other function of the torch, and sometimes requiring rejection or costly reworking of the incompletely coated substrate article.

BRIEF SUMMARY OF THE INVENTION

It is an object of the invention to provide an improved torch of the character indicated, avoiding or substantially reducing operational problems of past configurations.

A specific object is to meet the above object via characterizing features of the nozzle construction per se, whereby "flash-back" tendencies can be materially reduced and localized near the region of multiple-jet discharge for establishment of the flame of the torch.

Another specific object is to provide such a nozzle as a simple removable attachment to the gas and powder distributor of a torch assembly.

A general object is to meet the above objects with minimum modification of existing torch structures, with inherent simplicity of construction and ease of servicing, and without undue expense.

The foregoing objects and other features are achieved by the invention as applied to a nozzle construction for removable attachment to the gas and powder distributor of a torch for flame-spraying of powder material, the configuration being such that a flow of powder material is discharged within a surrounding annular locus of torch-flame development. Flash-back tendencies are reduced to relative insignificance by providing within the nozzle first and second successive annular manifold cavities of relatively large sectional area for supply of a flow of combustible-gas mixture to an angularly spaced plurality of discharge-jet passages, there being a circumferentially continuous annular restrictive baffle formation between the two large-area manifold cavities. The dimensional proportions of the manifolds of the baffle restriction and of the discharge-jet passages are important to achievement of the indicated objects.

DETAILED DESCRIPTION

Illustrative embodiments of the invention are shown in the accompanying drawings, in which.

Figures 1, 2, 3:
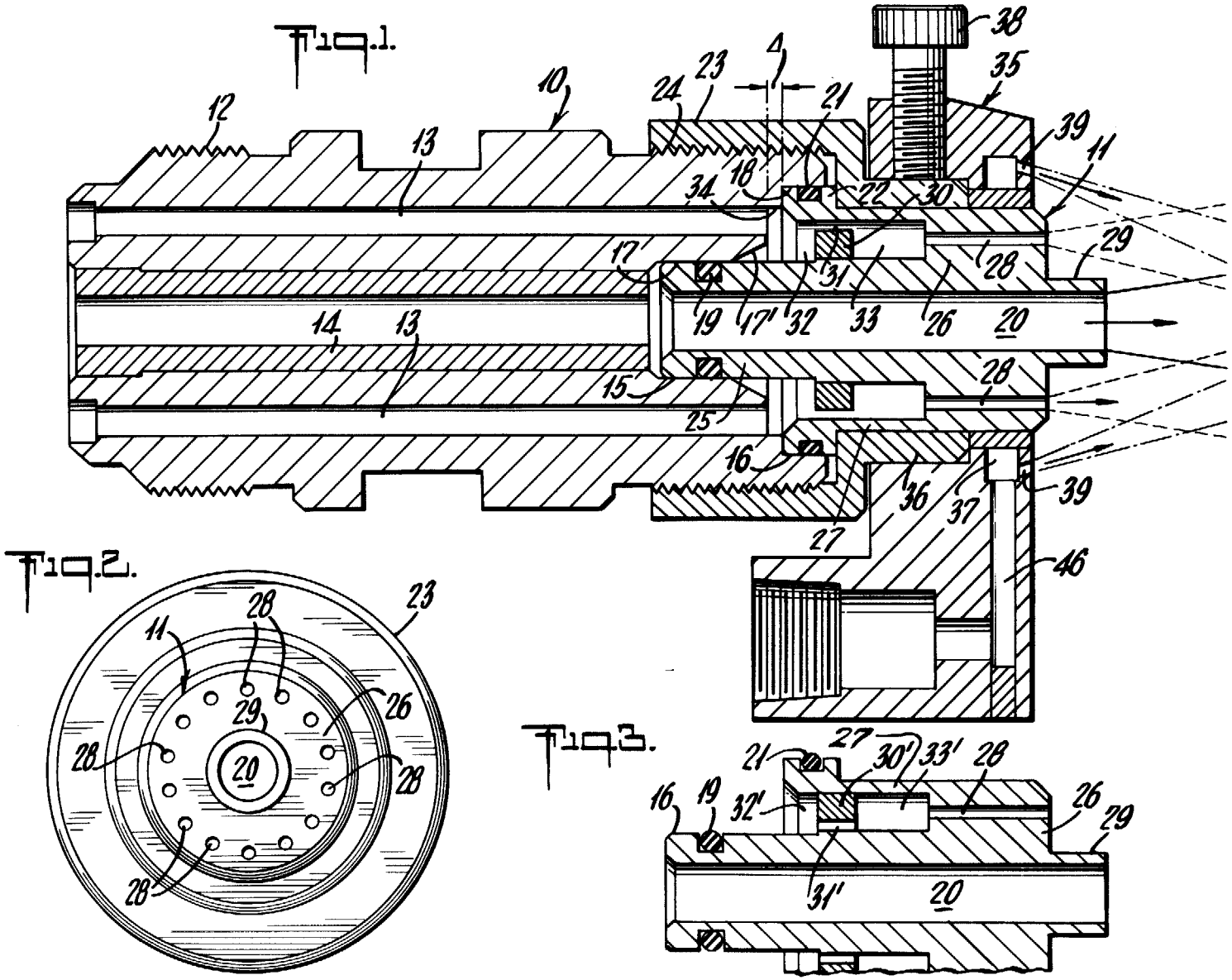
FIG. 1 is a longitudinal sectional view of a gas distributor of a torch, a preferred nozzle of the invention being shown secured to the distributor, and a flame-shaping shroud being mounted to the nozzle.
FIG. 2 is a right-end view of the nozzle of FIG. 1, shown without the shroud of FIG. 1.
FIG. 3 is a fragmentary view similar to FIG. 1, to show a modified nozzle construction.

In FIG. 1, the invention is shown in application to a gas distributor 10 carrying a detachably secured nozzle 11 of the invention. The gas distributor 10 includes means, such as threads 12 at its upstream end, for attachment to available flame-spraying torch-body structure (not shown) but which will be understood to include its own means for mixing oxygen with fuel gas, such as acetylene, to provide a continuous flow of the same to plural angularly spaced elongate passages 13 in the annular body of distributor 10. At the same time, the torch body will be understood to include provision for suitably controlled carrier-gas entrainment of powder to be sprayed, the flow of carrier gas and powder being independently delivered to the upstream end of a central passage of the distributor 10; such central passage is shown lined with a wear-resistent sleeve-liner insert 14, as of tungsten carbide.

The nozzle 11 is a replaceable insert characterized by first and second cylindrical lands 15–16 having sealed telescopic fit to inner and outer counterbores 17–18 at the downstream end of distributor 10. A first of these seals is provided by an elastomeric O-ring 19 in a peripheral groove in the land 15, thus assuring independence of carrier gas and powder flow, along a straight central course from the distributor liner 14 to the straight central bore 20 of nozzle 11. The second of these seals is provided by a second elastomeric O-ring 21 in a peripheral groove in the land 16, the latter being the outer finish of a shoulder-forming radial flange 22; a flanged nut 23 circumferentially engages the shoulder at flange 22 and removably retains the telescoping fit via threaded engagement to distributor 10, at 24. The land 15 extends beyond land 18 in the upstream direction, so that in insertably assembling nozzle 11 to distributor 10, initial centering contact will be made by the chamfered end of land 15 to a flare or bevel formation 17' at the downstream end of counterbore 17.

The nozzle 11 comprises a cupped generally cylindrical body with a central tubular stem 25 extending in the upstream direction, from the closed end 26 of the body and coaxially within the skirt 27 of the body, to define a relatively large manifold region between the stem 25 and the skirt 27 of the body. And the downstream end of the manifold region communicates with a plurality of elongate cylindrical discharge-jet passages 28, at angularly spaced locations about the nozzle axis. A central tubular extension 29 of passage 20 assures carrier-gas and powder discharge at a location downstream of the base of flame development, at the respective discharge ends of jet passages 28.

In the form of FIG. 1, an annular baffle ring 30 is secured to the outer wall surface of the tubular stem 25, at a location intermediate the longitudinal ends of the inner wall surface of the body skirt 27, thus establishing a succession of communicating first, second, and third annular manifold regions, namely, a substantially restricted but circumferentially continuous manifold region (second annular manifold region) 31 between a substantially larger upstream manifold region (first annular manifold region) 32 and a substantially larger downstream manifold region (third annular manifold region) 33. And by providing in distributor 10 an intermediate counterbore 34 of axial extent Δ, adjacent to and upstream from counterbore 18, a substantially enlarged circumferentially continuous extension of manifold region 32 is established for free and unimpeded combustible-gas supply from passages 13 to the manifold region 32.

For assurance against flash-back in the context of the relatively great flows of combustible-gas mixture contemplated for the described structure, it is important that certain dimensional proportions be observed. Thus, the combined sectional areas of the discharge jets 28 should be less than the sectional area of the restricted (baffled) annular manifold 31, and the latter should be less than the combined sectional areas of the distributor passages 13; by the same token, the sectional area of each of the manifold regions 32–33 should substantially exceed that of the restricted manifold 31. The axial length of all discharge-jet passages 28 should be at least five and preferably about ten times their diameter; and the axial length of the restricted manifold region 31 should be several times its radial span, being shown as preferably three times.

More specifically, for an illustrative case of a torch equipped with a distributor 10 and nozzle 11 and wherein oxy-acetylene mixture provided a maximum 1250 b.t.u. per minute flame discharge, in the circumstance of inert carrier gas and non-exothermic powder, the jet passages 28 were 0.035-inch diameter and 0.375-inch length. The restrictive radial gap at 31 was 0.031 inch to a skirt 27 having a bore diameter of 0.60 inch, the length of gap 31 being 0.094 inch. And the distributor passages were six in number, and of 0.094 inch diameter. The combined sectional area at 28 was thus 14 times 0.0243 $in^2$, i.e., 0.340 $in^2$; the restrictive area at 31 was 0.026 $in^2$, and the combined sectional area at 13 was 0.040 $in^2$; thus importantly, the restrictive area at 31 is close to but greater than the combined sectional area of discharge at 28, but the area at 31 is substantially less than the combined feed area at 13. A smooth flame of the indicated heat output is developed, free of flash-back, and even in the circumstance of carrier gas and/or powder material contributing to the heat development, there were no disabling flash-backs.

It will be seen that the described structure meets all stated objects. The nozzle 11 per se is structurally simple, effective in performance, and easily removed and installed.

While the invention has been described for the preferred forms of FIGS. 1 and 2, it will be understood that modifications may be made without departure from the scope of the invention. For example, detachable annular shroud subassembly 35 may be telescopically fitted to the downstream end of nozzle 11, being shown in partial overlap with an elongate hub portion 36 of nut 23, for attachment by set-screw means 38. The subassembly 35 is characterized by an annular manifold cavity 37 serving a plurality of inwardly canted discharge jets 39, for directional discharge of flows of air, inert gas or oxygen, provided by independent supply via passage means 40. When such jets 39 are sufficiently close and in sufficient number, they achieve a gas shroud around the flame spray, serving to accelerate the same; and two such jets 39, at diametrically opposite locations will produce a flame-flattening effect upon the discharge of flame and powder, thus enabling the user to apply the flame spray as a ribbon. Other flame-shaping configurations are disclosed in my copending patent application, Ser. No. 131,199, filed Mar. 17, 1980.

Still further, although the form of FIGS. 1 and 2 has been said to be preferred, it is possible to achieve the indicated baffle effect by forming the restrictive gap 31' (between manifolds 32'–33') along the outer-wall surface of stem 25, as shown specifically in FIG. 3. However, it will be appreciated that to achieve the same sectional area for restrictive gap 31' (FIG. 3) as for gap 31 (FIG. 1), all other conditions being the same, the gap 31' will necessarily be of greater radial extent than the gap 31, due to the shorter radius at which gap 31' is located.

What is claimed is:

1. A flame-spraying torch including an elongate gas distributor and a nozzle carried at the discharge end of said distributor, said distributor and nozzle having aligned communicating lengths of a central passage for carrying and ejecting a flow of carrier gas and particle material to be flame-sprayed, said distributor having elongate passage means for carrying to said nozzle a flow of combustible gas mixture, said nozzle having an angularly distributed plurality of discharge-jet passages at spaced locations around said central passage, and said nozzle having first, second and third communicating annular manifold regions surrounding said central passage and providing passage connection for combustible gas from said distributor to said discharge-jet passages, said first annular manifold region receiving combustible-gas flow from said distributor and being of effective sectional area greater than that of the combustible-gas passage means of said distributor, said second annular manifold region being of substantially smaller effective sectional area than that of the combustible-gas passage means of said distributor, and said third annular manifold region being of effective section area substantially greater than that of said second annular manifold region and also substantially greater than the combined effective sectional areas of said discharge-jet passages, whereby said second manifold region provides a baffle function operative to confine flash-back action to the immediate vicinity of said nozzle and to effectively isolate the distributor from flash-back.

2. The torch of claim 1, in which the communicating lengths of said central passage are defined by a first circumferentially sealed telecoping fit of coacting cylindrical distributor and nozzle formations, said distributor and nozzle having further cylindrical formations establishing a second circumferentially sealed telescoping fit radially outside the mixture passage means of said distributor.

3. The torch of claim 2, in which said further cylindrical formation of said nozzle is the grooved outer rim of a radial flange, and a nut removably threaded to said distributor body and axially engaging said flange to retain said nozzle in assembly to said distributor.

4. The torch of claim 2, in which said nozzle formation having said first fit is a tubular stem extending through all said manifold regions, and a constricting ring member fitted to an axially intermediate region of said stem and having such radial clearance with the further cylindrical formation of said nozzle as to thereby define said second annular manifold region.

5. The torch of claim 4, in which an annular body mounted to the downstream end of said nozzle defines a further annular manifold radially outside the gas-discharge-jet passages of said nozzle, said annular body having an angularly spaced plurality of downstream-directed discharge-jet passages communicating with said further manifold, and means for supplying a flow of pressurized gas to said further manifold.

6. The torch of claim 5, in which said annular body includes means for removably clamping the same to said nozzle.

* * * * *